US009035766B2

(12) United States Patent
Worthington et al.

(10) Patent No.: US 9,035,766 B2
(45) Date of Patent: May 19, 2015

(54) SYSTEM AND METHOD OF DETERMINING GAS DETECTOR INFORMATION AND STATUS VIA RFID TAGS

(75) Inventors: Stephen D. Worthington, Calgary (CA); Sean Everett Stinson, Calgary (CA)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 258 days.

(21) Appl. No.: 12/831,908

(22) Filed: Jul. 7, 2010

(65) Prior Publication Data

US 2012/0007736 A1 Jan. 12, 2012

(51) Int. Cl.

| | |
|---|---|
| ***G08B 1/08*** | (2006.01) |
| ***G08B 29/14*** | (2006.01) |
| ***G08B 17/117*** | (2006.01) |

(52) U.S. Cl.

CPC ..... *G08B 29/14* (2013.01); *G08B 17/117* (2013.01)

(58) Field of Classification Search

CPC .... G08B 25/10; G08B 21/0453; G08B 25/08; G08B 13/1427; G08B 13/1436; G08B 21/0213; G08B 21/0269; G08B 21/0275; G08B 21/043; G08B 21/0492; G08B 21/22; G08B 21/24; G08B 23/00; G08B 25/009; G08B 13/02; G08B 29/14; G08B 7/117; G01D 5/00; G06K 7/01

USPC ..... 340/10.1, 13.26, 539.22, 539.1; 235/462.01, 439; 204/424

See application file for complete search history.

(56) References Cited

U.S. PATENT DOCUMENTS

| | | | | |
|---|---|---|---|---|
| 6,720,866 | B1 * | 4/2004 | Sorrells et al. | 340/10.4 |
| 7,539,520 | B2 * | 5/2009 | Twitchell, Jr. | 455/574 |
| 8,133,178 | B2 * | 3/2012 | Brauker et al. | 600/365 |
| 2004/0212497 | A1 * | 10/2004 | Stilp | 340/539.17 |
| 2004/0215750 | A1 * | 10/2004 | Stilp | 709/220 |
| 2005/0088299 | A1 * | 4/2005 | Bandy et al. | 340/539.16 |
| 2005/0151643 | A1 * | 7/2005 | Rajapakse et al. | 340/545.2 |
| 2005/0156711 | A1 * | 7/2005 | Aljadeff et al. | 340/10.34 |
| 2005/0248455 | A1 * | 11/2005 | Pope et al. | 340/539.27 |
| 2005/0252979 | A1 * | 11/2005 | Konuma et al. | 235/492 |
| 2006/0071009 | A1 * | 4/2006 | Kaye | 220/723 |
| 2006/0116842 | A1 * | 6/2006 | Tarantola et al. | 702/122 |
| 2006/0164213 | A1 * | 7/2006 | Burghard et al. | 340/10.2 |
| 2007/0013236 | A1 * | 1/2007 | Fleiner et al. | 307/326 |
| 2007/0096882 | A1 * | 5/2007 | Bandy et al. | 340/10.51 |

(Continued)

FOREIGN PATENT DOCUMENTS

KR 10-2008-0095992 10/2008

OTHER PUBLICATIONS

PCT International Search Report corresponding to International Application No. PCT/US2011/042986, dated Jan. 13, 2012.

(Continued)

*Primary Examiner* — Jennifer Mehmood
*Assistant Examiner* — Rufus Point
(74) *Attorney, Agent, or Firm* — Husch Blackwell LLP

(57) ABSTRACT

In large systems of ambient condition detectors the respective detectors can each include an RFID-type tag or integrated circuit. The tag can transmit detector identification information and status information wirelessly to a displaced receiver. Receivers can be installed in docking/test stations as well as in portable units which can be carried by an individual entering, or, moving through a region being monitored by the detectors.

19 Claims, 2 Drawing Sheets

RFID ENABLED GAS DETECTOR SYSTEM

(56) References Cited

U.S. PATENT DOCUMENTS

| | | | | |
|---|---|---|---|---|
| 2007/0138251 | A1* | 6/2007 | Mattlin et al. | 235/375 |
| 2007/0209937 | A1* | 9/2007 | Hoagland et al. | 204/424 |
| 2008/0030324 | A1* | 2/2008 | Bekritsky et al. | 340/539.22 |
| 2008/0042830 | A1* | 2/2008 | Chakraborty et al. | 340/540 |
| 2008/0184795 | A1* | 8/2008 | Woodard | 73/304 C |
| 2008/0231836 | A1* | 9/2008 | Curello et al. | 356/72 |
| 2009/0037634 | A1* | 2/2009 | Kuris et al. | 710/303 |
| 2009/0184165 | A1* | 7/2009 | Bertness et al. | 235/462.01 |
| 2009/0204250 | A1* | 8/2009 | Potyrailo et al. | 700/109 |
| 2009/0243836 | A1* | 10/2009 | McSheffrey | 340/524 |
| 2009/0308134 | A1* | 12/2009 | Pepper | 73/1.06 |
| 2010/0012653 | A1* | 1/2010 | Ulrich et al. | 220/1.5 |
| 2010/0033323 | A1* | 2/2010 | Tsai et al. | 340/539.31 |
| 2010/0066561 | A1* | 3/2010 | Ulrich et al. | 340/870.07 |
| 2010/0134257 | A1* | 6/2010 | Puleston et al. | 340/10.4 |
| 2010/0214061 | A1* | 8/2010 | Twitchell et al. | 340/5.61 |
| 2011/0043373 | A1* | 2/2011 | Best et al. | 340/825.49 |
| 2011/0148624 | A1* | 6/2011 | Eaton et al. | 340/539.13 |
| 2012/0001730 | A1* | 1/2012 | Potyrailo et al. | 340/10.1 |
| 2012/0005344 | A1* | 1/2012 | Kolin et al. | 709/226 |
| 2012/0007736 | A1* | 1/2012 | Worthington et al. | 340/539.22 |

OTHER PUBLICATIONS

PCT Written Opinion of the International Searching Authority corresponding to International Application No. PCT/US2011/042986, dated Jan. 13, 2012.

English translation of unexamined KR Patent No. 10-2008-0095992.

European Search Report from corresponding EP patent application 11804263.9, dated Nov. 28, 2014.

* cited by examiner

RFID ENABLED GAS DETECTOR SYSTEM

SYSTEM AND METHOD OF DETERMINING GAS DETECTOR INFORMATION AND STATUS VIA RFID TAGS

FIELD

The invention pertains to systems that need large numbers of gas or smoke detectors to monitor an industrial or commercial environment. More particularly, the invention pertains to detecting the status of such detectors in the context of managing large industrial environments such as refineries.

BACKGROUND

Large numbers of gas detectors are frequently required during events such a refinery shutdowns and there are several companies that provide rental instruments as a service. In the event of large refinery shutdowns, several thousand rental gas detectors may be required. In these situations, both the rental company and the company using the detectors have to manage a large number of instruments. They must determine ownership of instruments as well as verify the operational status of each instrument.

While every instrument has a unique serial number, it can be difficult to read and the operational status of the instrument (i.e. is the calibration and bump check status up to date). It is desirable to have some means of quickly and reliably reading large numbers of instrument serial numbers as well as the associated operational status. It is also desirable to collect this information without having to remove detectors from packaging or shipping containers.

DETAILED DESCRIPTION

Figure 1:
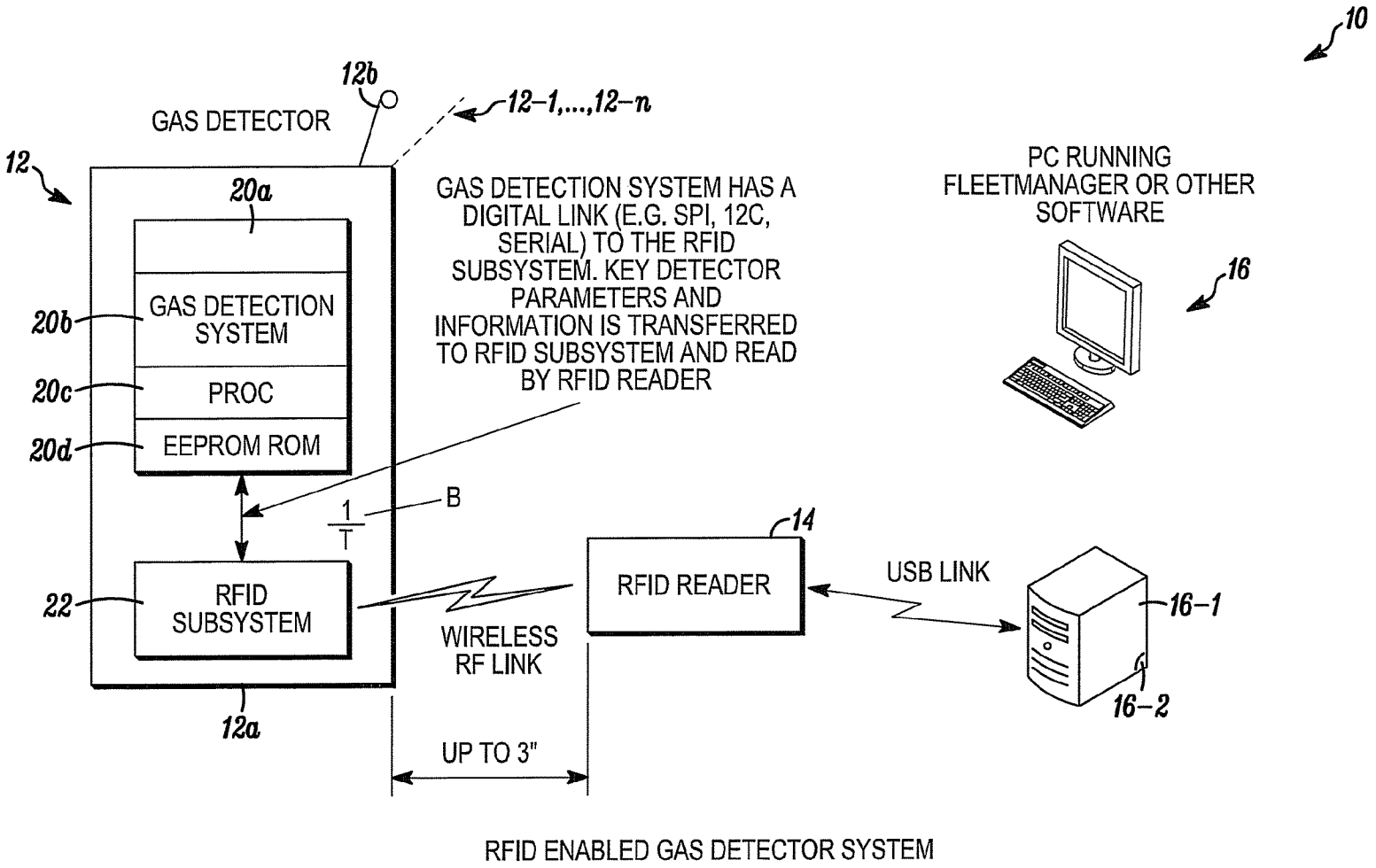
FIG. 1 is a block diagram of an RFID enabled system which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention can include adding an RFID tag chip to at least some of the detectors. RFID tag chips contain pre-programmed information and when interrogated by an RFID reader, they respond. RFID tags do not need external power and will respond even when the instrument is switched off or inactive.

The RFID tag can be programmed with the instrument serial number, model number and sensor configuration by the manufacturer. This information will be permanently stored in the RFID tag and will allow anyone with an RFID reader to query the instrument. This will allow easy asset tracking for the detectors.

In an aspect of the invention, the RFID tag can transmit the current status of the detector. This adds significant value because it allows users to easily determine the status of instruments even if they are in cartons or other containers. The current status of the instrument can be encoded into the RFID tag in different ways.

In a disclosed embodiment, an RFID tag with an external interface can be incorporated into the circuitry of a detector. One such RFID tag is commercially available as an Atmel ATA5570 RFID IC. This device has an external sensor input that allows the IC to indicate whether an external resistance is high or low when queried. The detector circuit can be constructed such that the external resistance is high when the detector is operating properly (all self-tests passed, sensors within calibration interval and within bump check range) and low when the detector is out of conformance with pre-determined parameters and in need of maintenance.

Alternately, RFID tags with digital interfaces are available commercially. These interfaces allow considerably more information to be transferred from a programmable processor, or microcontroller in the gas detector to the RFID tag. Examples of these chips include, without limitation, Texas Instruments TMS37157, ST Microelectronics M24KR64, a Melexis ML90129 and a Ramtron WM72016. The information transferred from the gas detector's microcontroller to the RFID chip through this interface can include gas detector status, last calibration date, gas type, etc. Such additional information can be used by a displaced, or, an external monitoring system as would be understood by those of skill in the art.

In another embodiment, a docking/test station can be equipped with an RFID reader/writer. When an instrument is bump tested or calibrated, the docking/test station can use the RFID reader/writer to update the information in the RFID tag on the associated detector. The RFID tag on the detector could then retain the most recent dates for bump testing and calibration operations.

In either of the above embodiments handheld RFID readers could query the detectors for the stored information at any time.

In mustering applications, RFID tags in detectors duplicate the function of security tags in use. In this embodiment, users can scan in at a mustering point with their detector instead of an id badge.

In access control related applications, a gas detector can be used to control entry to restricted areas. For example, the gas detector must be of the correct type and in working condition (bump check valid, etc.) in order to gain entry to an area.

In inventory management related applications, a box of detectors can be scanned with an RFID reader. The detectors could then be signed in or out of a facility as a group. This aspect can be used to manage large numbers of detectors in rental fleets, manufacturing, distribution, etc.

In yet another aspect of the invention, detector status can be checked via an RFID reader at facility entry points. If a detector is compliant with policy (correct gas type, bump check & calibration interval correct, self-tests passed, etc.) then the user can enter facility. Readers can be installed at facility gates and/or operations offices. This process can also be implemented in the facility using a hand held RFID reader. This is useful for performing spot checks.

Further, the status of one or more detectors can be checked at exit points to see if an alarm/event occurred during the user's shift. If an alarm was reported, the user can complete an incident report either on paper or on-line. A hand held computer with an RFID reader can be used to enter incident reports on the spot reducing time for incident reporting.

Embodiments of the invention support loss prevention programs. For example, RFID reader gates can be set up at facility entry/exit points. Detectors passing through these points can then be recognized and a signal is generated which indicates that presence of a detector has been recognized. Thus, detectors can be signed out and/or returned to the facility.

Preferably, onboard RFID tags in respective devices can be programmed with user information such as operator name and/or Operator ID.

FIG. 1 illustrates a system 10 in accordance with the invention. The system 10 can include a plurality of RFID-type enabled detectors 12, 12-1, 12-2 . . . **12-*n*, of which detector 12 is an example. The detectors, such as 12 are in wireless communication, intermittently, with an RFID reader 14 which is in turn coupled to a gas detector data management system 16. System 16 can be implemented with one or more personal computers, such as 16-1 which execute data management and collection software 16-2**.

The components of detector 12, and the other members of the plurality 12-1 . . . **12-*n* can be carried in a respective portable housing such as 12*a*. A clip 12*b*, of a type that can be used to attach the detector 12 to clothing or equipment of a user, is affixed to the housing 12*a*. The detector 12** can be energized by an internal, replaceable battery B.

As will be understood by those of skill in the art, the detectors, such as detector 12 can include a gas sensor **20*a* which is in turn coupled to interface circuitry 20*b*. The interface circuitry 20*b* can in turn be coupled to a programmable processor 20*c*. The processor 20*c* can include or be coupled to storage unit(s) 20*d* such as EEPREOM or ROM storage devices which can store control software executable by the processor 20*c***.

An RFID subsystem, interface, 22 is carried by housing **12*a* and coupled to the sensor/control circuits 20. Interface 22 is in wireless communication with the RFID reader 14**.

Figure 2:
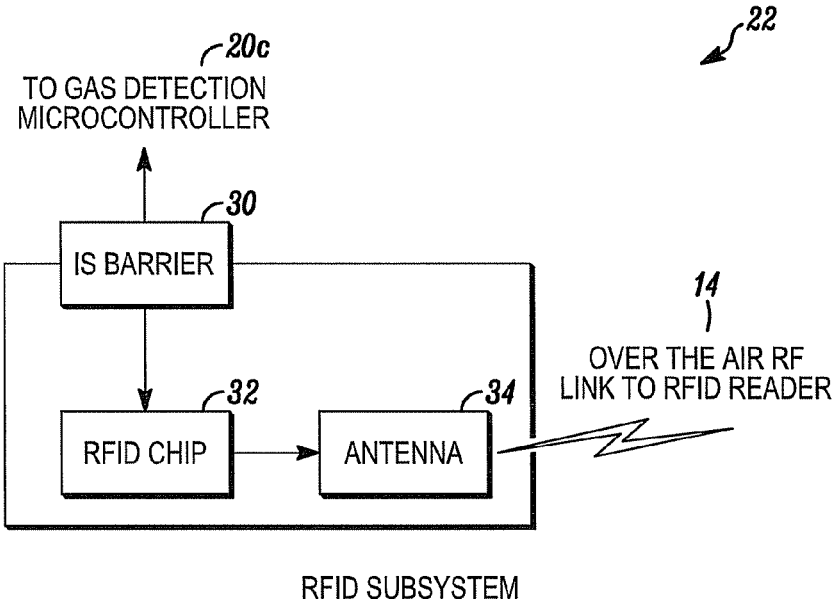
FIG. 2 is a block diagram of an RFID related subsystem of FIG. 1.

As illustrated in FIG. 2, the RFID subsystem 22 includes an RFID chip 32. The RFID chip 22 includes some nonvolatile memory which is used to store gas detector information. The information stored in the RFID chip 22 can include, without limitation:

Detector model number
Detector serial number
Gas type of detector
Operator name
Last calibration date
Last bump test date
Last alarm date
Power up self test status (pass or fail)
Current status information (pass or fail)

The above representative information can be obtained from the gas detection circuitry 20 and can be written to the RFID chip 32 by the gas detector microcontroller **20*c*. The over the air RF link can be used to read data from the RFID chip 32**.

As those of skill will understand, all of the information listed above can be stored in the EEPROM **20*d* on the RFID chip 32 prior to interrogation by an RFID reader 14. The Status information can change suddenly (if the battery is removed for example) and the processor 20*c* may not have the opportunity or ability to update the status in the RFID chip's EEPROM 20*d*. In this case, the RFID chip 32 can initiate a read of the status information from the gas detector processor, or microcontroller, 20*c* over a digital link 32*a* when an RFID reader 14 interrogates the RFID chip 32**.

Figure 3:
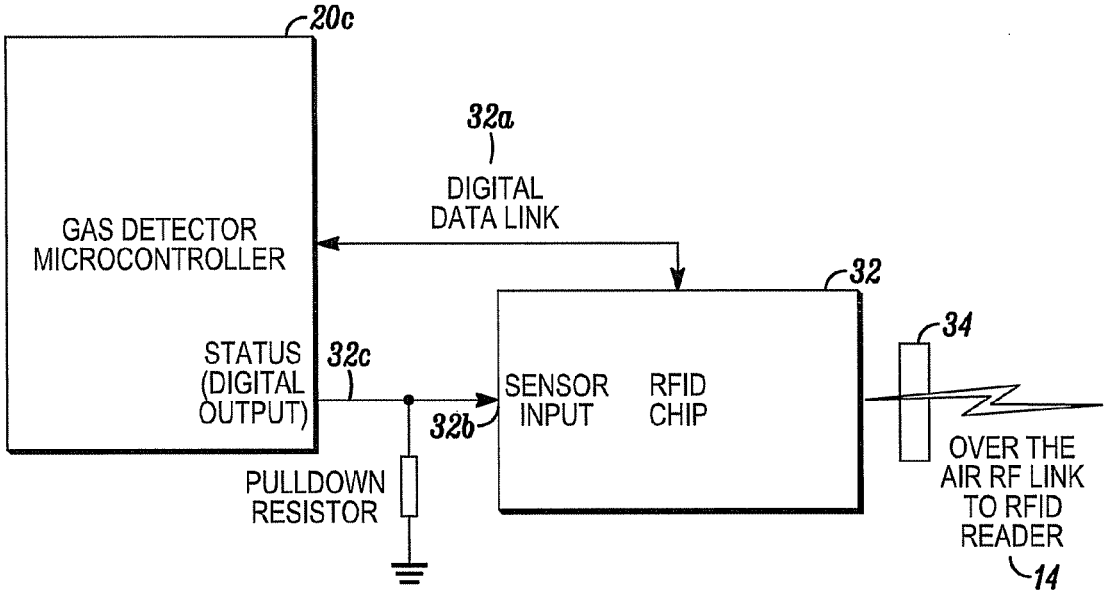
FIG. 3 is another block diagram of an RFID enabled detector in accordance with invention.

Alternately, if the RFID chip 32 has a sensor input **32*b* it can be used to indicate status information over the RF link. Some RFID chips have a sensor input where an analog voltage can be read. A digital output 32*c* on the gas detector microcontroller 20*c* can be connected to the RFID 32 chip as illustrated in FIG. 3**.

For example, if the microcontroller **20*c* is off, or the microcontroller pulls the status line 32*c* low to indicate an off state, then the RFID chip 32 will read a low voltage at the sensor input pin 32*b*. This will in turn be reported back to the RFID reader 14 when the RFID chip 32 is queried. Similarly, when the microcontroller 20*c* pulls the status line 32*c* high the RFID chip 32 reads a high voltage at the sensor input pin 32*b*** and status indicator is reported as being active.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

a plurality of ambient condition detectors, where at least some of the detectors are energized by a respective internal replaceable battery and include a respective RFID-type tag added to each of the at least some detectors, wherein the detector includes a tag interface coupled to the tag; the respective RFID-type tag responds to external interrogation even when a corresponding detector of the at least some detectors is switched off or inactive, where at least current status information relative to the corresponding detector including one or more of detector model number, detector serial number, gas type of detector, operator name, latest calibration date, last bump test date, last alarm date, power up self-test status and current status information is encoded in the tag by a processor of the corresponding detector prior to any interrogation of the respective RFID-type tag and wherein upon interrogation, the respective RFID-type tag reads whether the corresponding detector is in an active state or an off state and reports the status information.

2. A system as in claim 1 where at least some of the detectors each includes a tag interface coupled to the tag.

3. A system as in claim 2 where the detector includes control circuits coupled to the tag interface.

4. A system as in claim 1 which includes a docking apparatus to test the respective detector and to update the respective tag.

5. A system as in claim 1 where the detector includes a gas sensor.

6. A system as in claim 5 which includes a docking apparatus to test the respective detector and to update the respective tag.

7. A system as in claim 1 where the tag includes at least status information for the detector.

8. A system as in claim 1 which includes a wireless, portable RFID-type tag reader to obtain detector information from a location displaced from the detector.

9. A system as in claim 1 where at least some of the detectors include an intrinsically safe barrier between the respective tag and selected other circuits of the respective detector.

10. A system as in claim 9 where the ambient condition detector is coupled to an RFID subsystem which includes at least the respective tag and an associated antenna with the intrinsically safe barrier between the tag and antenna and the selected other circuits.

11. A system as in claim 1 where the detectors comprise detectors of a selected gas and where the detectors carry an article attaching clip.

12. A system as in claim 1 which includes a detector management system to collect and manage data from the detectors.

13. A detector comprising:

a housing;

an article attaching clip attached to the housing;

gas detecting circuitry carried by the housing;

an internal replaceable battery within the housing that energizes the gas detecting circuitry; and RFID chip circuits added to the housing, the RFID chip circuits are carried by the housing and coupled to the gas detecting circuitry, the RFID chip circuits respond to external interrogation even when the gas detecting circuitry is switched off or inactive, wherein at least current status information of the gas detecting circuitry including at least one or more of detector model number, detector serial number, gas type of detector, operator name, latest calibration date, last bump test date, last alarm date, power up self-test status and current status information is written in the RFID chip circuits by the gas detecting circuitry prior to any interrogation thereof and wherein upon interrogation, the RFID chip circuits reads whether the corresponding detector is in an active state or an off state and reports the status information.

14. A detector as in claim 13 where the RFID chip circuits include an RFID-type element and an associated antenna.

15. A detector as in claim 14 where an intrinsically safe barrier is positioned between at least the element and other circuitry carried by the housing.

16. A detector as in claim 15 where the RFID chip circuits include an RFID transmitting element with an input port.

17. A detector as in claim 16 where the detecting circuitry includes a programmable processor which provides status information to the input port.

18. A detector as in claim 17 where the gas detecting circuitry emits an alarm indicia in the event that the concentration of detected gas exhibits a predetermined criterion.

19. A detector as in claim 13 wherein the RFID chip circuits further comprise an EEPROM that stores information.

* * * * *